US005995781A

United States Patent [19]

Matsuo

[11] Patent Number: 5,995,781

[45] Date of Patent: Nov. 30, 1999

[54] IMAGE FORMATION APPARATUS

[75] Inventor: Minoru Matsuo, Kanagawa, Japan

[73] Assignee: Ricoh Company, Ltd., Tokyo, Japan

[21] Appl. No.: 09/066,777

[22] Filed: Apr. 27, 1998

[30] Foreign Application Priority Data

| | | | |
|---|---|---|---|
| Apr. 25, 1997 | [JP] | Japan | 9-123190 |
| Apr. 25, 1997 | [JP] | Japan | 9-123192 |
| Apr. 28, 1997 | [JP] | Japan | 9-125032 |
| Apr. 28, 1997 | [JP] | Japan | 9-125033 |
| Mar. 4, 1998 | [JP] | Japan | 10-069449 |
| Apr. 22, 1998 | [JP] | Japan | 10-129641 |
| Apr. 22, 1998 | [JP] | Japan | 10-129642 |

[51] Int. Cl.[6] ..... G03G 21/00

[52] U.S. Cl. ..... 399/98; 399/176

[58] Field of Search ..... 399/98, 174, 175, 399/176, 91

[56] References Cited

U.S. PATENT DOCUMENTS 5,666,607 9/1997 Camis ..... 399/176

FOREIGN PATENT DOCUMENTS 59-204057 11/1984 Japan .

60-95459 5/1985 Japan .

*Primary Examiner*—William Royer
*Assistant Examiner*—William A. Noe
*Attorney, Agent, or Firm*—Oblon, Spivak, McClelland, Maier & Neustadt, P.C.

[57] ABSTRACT

An image formation apparatus includes an image bearing member which is capable of forming a latent electrostatic image thereon, a contact charging member which charges a surface of the image bearing member with the application of electric charges thereto, with the image bearing member and the charging member being in rotation contact, and a non-ozone-generating gas supply device for supplying a non-ozone-generating gas to a chargeable space which extends from a contact position of the contact charging member with the image bearing member and is positioned between (a) a surface of the contact charging memeber and (b) a surface of the image bearing member, with the surfaces facing each other, on an upstream side of the contact position with respect to a rotating direction of the contact charging member, the non-ozone-generating gas being capable of hindering the generation of ozone which is generated in the course of the application of electric charges to the surface of the image bearing member by the contact charging member.

16 Claims, 10 Drawing Sheets

IMAGE FORMATION APPARATUS

BACKGROUND OF THE INVENTION

1. Field of the Invention

The present invention relates to an image formation apparatus, using a contact charging method, which is capable of preventing the generation of ozone and NOx components in the course of corona charging, using a non-ozone-generating gas with the prevention of the dissipation thereof from a corona a charging area with a simple mechanism.

2. Discussion of Background

In image formation apparatus such as copying machines, printers and facsimile apparatus, images are formed by electrophotography, which comprises a series of processes of uniformly charging a surface of a photoconductor whose surface resistivity changes depending upon the intensity of light applied thereto, forming a latent electrostatic image corresponding to an output image on the uniformly charged surface of the photoconductor, with the application of a laser beam thereto, developing the latent electrostatic image to a visible toner image with a toner which is electrically charged, transferring the developed toner image to a charged transfer sheet such as a sheet of paper, quenching the charges of the transfer sheet, peeling the transfer sheet away from the surface of the photoconductor, and fixing the toner image on the transfer sheet thereto with the application of heat and pressure thereto. After the above-mentioned series of processes in electrophotography, a residual toner remaining on the surface of the photoconductor is removed, residual charges on the surface of the phoconductor are quenched, and then the surface of the photoconductor is uniformly charged for the next image formation.

In electrophotography, the movement of charges is utilized in each of the processes of charging, development, image transfer, and charge quenching, and the generation of charges is carried out, for example, by a corona charging method, a triboelectric charging method, or a contact charge injection method. Of these charge generation methods, the corona charging method is most in general use.

In the corona charging method, corona charges are generated with the application of a high voltage across an electrode made of a thin wire or a stylus and a counterelectrode, and ions generated by the corona charges are applied to a chargeable member such as a photoconductor. The principle of the corona charging method is very simple and the structure of an apparatus to perform the corona charging method is also very simple. However, since the corona charging is carried out in air, oxygen which occupies 20% of the components of air is ionized, so that ozone ($O_3$) is generated. Ozone is an important compound for the ozone layer in the stratosphere which acts as a shield against penetration of UV light in the sun's rays. However, ozone is toxic in offices and the generation thereof must be controlled.

The triboelectric charging method and the contact charge injection method are applied to a development roller and a charging roller. However, in the triboelectric charging method and the contact charge injection method, since the development roller or the charging roller remains in contact with the surface of a photoconductor which is a chargeable material even when the method is not carried out, low-molecular-weight components separate out from a rubber roller of the roller and are transferred to the photoconductor, whereby the photoconductor is contaminated with such low-molecular-weight components, eventually causing abnormality in image formation. The triboelectric charging method and the contact charge injection method have such a shortcoming as mentioned above.

Under such circumstances, recently a contact charging method is employed, in which the surface of a charging member is caused to have high resistivity, and a charging portion of such a charging member is successively brought into contact with the surface of a chargeable member such as a photoconductor, so that corona charging is conducted in a micro space around the charging portion of the charging member which is in contact with the chargeable member, whereby the surface of the chargeable member is uniformly charged with the application of charges thereto.

Even in the above-mentioned contact charging method, however, as long as corona charging is used, oxygen in air is ionized, so that ozone and NOx components are inevitably generated. The NOx components are hygroscopic, so that when the NOx components are deposited on the surface of the photoconductor, abnormal images with image flow are formed. Furthermore, when the NOx components are deposited on the surface of the photoconductor or the surface of a charging roller, and the charging roller comes into contact with the photoconductor, it may occur that low-molecular components are transferred from the charging roller to the photoconductor. When such transfer of the low-molecular components occurs and a copying operation is resumed, non-transferred spots are formed in copied images.

Therefore it is desired that a gas that hinders the generation of ozone in the charging atmosphere be developed. As one of the proposals for attaining this, a method of using an oxygen-concentration-reduced air is proposed in Japanese Laid-Open Patent Application 60-95459. When the concentration of oxygen in air is merely reduced, the amount of ozone generated in the course of corona charging can be reduced. However, the generation of ozone cannot be stopped completely. Furthermore, the electric current in the corona charging varies depending upon the kind of gas employed. The result is that charging potential varies depending upon the kind of gas employed and accordingly image density varies. In order to prevent such problems, it is necessary to use a gas-separation filter, which will make the charging apparatus complicated in mechanism.

Therefore it is desired to produce a charging atmosphere free of oxygen or a charging atmosphere in which ozone is not generated by corona charging even if oxygen is contained therein.

It is considered that nitrogen gas ($N_2$) which is a main component of air and is easily available can be used for producing the above-mentioned charging atmosphere. However, nitrogen gas ($N_2$) has a density which is close to the density of oxygen gas, so that nitrogen gas ($N_2$) easily disperses in air. Therefore, in order to produce and maintain a charging atmosphere composed of pure nitrogen gas, a special apparatus or a nitrogen gas supply apparatus is required.

Furthermore, as described in Japanese Laid-Open Patent Application 60-95459, NOx components are produced by corona charging in an atmosphere of nitrogen, so that the above-mentioned problems such as the increase of the hygroscopic properties of the photoconductor, and the reduction of the charging performance of the photoconductor are caused. Therefore such a charging method in which NOx components are produced should not be used.

As easily available non-ozone-generating gases, there are water vapor $H_2O$, hydrogen gas $H_2$, rare gases such as He, Ne, propane gas $C_3H_8$, and methane gas $CH_4$. As a matter of course, gases which catch fire cannot be used, and materials which are not in the state of a gas at room temperature cannot be used, either.

When a non-ozone-generating gas which is lighter than air is employed, a container for the non-ozone-generating gas by which the dissipation of the gas from the corona charging area can be prevented, or some device for continuously supplying the gas to the corona charging area is required.

SUMMARY OF THE INVENTION

It is therefore an object of the present invention to provide an image formation apparatus, using a contact charging method, which is capable of preventing the generation of ozone and/or NOx components in the course of corona charging, using a non-ozone-generating gas with the prevention of the dissipation thereof from a corona charging area with a simple mechanism.

The above object of the present invention can be achieved by an image formation apparatus which comprises:

image bearing means which is capable of forming a latent electrostatic image thereon, contact charging means which charges a surface of the image bearing means with the application of electric charges thereto, with the image bearing means and the charging means being in rotation contact, and non-ozone-generating gas supply means for supplying a non-ozone-generating gas to a chargeable space which extends from a contact position of the contact charging means with the image bearing means and is positioned between a surface of the contact charging means and a surface of the image bearing means, with the surfaces facing each other, on an upstream side of the contact position with respect to a rotating direction of the contact charging means, the non-ozone-generating gas being capable of hindering the generation of ozone which is generated in the course of the application of electric charges to the surface of the image bearing means by the contact charging means.

It is preferable that the above-mentioned image formation apparatus further comprise auxiliary space enclosure means for enclosing the chargeable space, which is in contact with at least one of a surface of the image bearing means or a surface of the contact charging means, on an upstream side with respect to a rotating direction of the image bearing means or on the upstream side with respect to the rotating direction of the contact charging means.

It is also preferable that the image formation apparatus further comprise shielding means for shielding the chargeable space at opposite sides thereof located on the opposite end sides of the image bearing means or on the opposite end sides of the contact charging means.

It is also preferable that the image formation apparatus further comprise both the auxiliary space enclosure means and the shielding means.

In the image formation apparatus, it is preferable that the non-ozone-generating gas have a specific gravity greater than that of air and that the chargeable space be situated in such a posture that the non-ozone-generating gas is prevented from dispersing out of the chargeable space.

It is preferable that the image formation apparatus further comprise pressure reduction means for reducing the pressure in the chargeable space.

The object of the present invention can also be achieved by an image formation apparatus which comprises:

an image bearing member which is capable of forming a latent electrostatic image thereon, a contact charging member which charges a surface of the image bearing member with the application of electric charges thereto, with the charging member being rotated in a predetermined direction in rotation contact with the image bearing member at the same rotation speed, and a non-ozone-generating gas supply member comprising a nozzle through which a non-ozone-generating gas is directed and supplied to a chargeable space which extends from a contact position of the contact charging member with the image bearing member and is enclosed by (a) a surface of the contact charging member, (b) a surface of the image bearing member, with the surfaces facing each other, on an upstream side of the contact position with respect to a rotating direction of the contact charging member, and (c) a tangent at a cross point of a vertical line which passes through a rotation center of the contact charging member with a circumference of the contact charging member, the tangent crossing or touching a circumference of the image bearing member, or a tangent at a cross point of a vertical line which passes through a rotation center of the image bearing member with a circumference of the image bearing member, the tangent crossing or touching a circumference of the contact charging member, the non-ozone-generating gas being capable of hindering the generation of ozone which is generated in the course of the application of electric charges to the surface of the image bearing member by the contact charging member.

It is preferable that the above image formation apparatus further comprise a rotatable auxiliary space enclosure member for enclosing the chargeable space, which is in contact with at least one of a surface of the image bearing member or a surface of the contact charging member, on an upstream side with respect to a rotating direction of the image bearing member or on the upstream side with respect to the rotating direction of the contact charging member.

In the above image formation apparatus, the image bearing member and the contact charging member may be each in the shape of a cylindrical drum, and the image formation apparatus further comprises a pair of shielding members for shielding the chargeable space at opposite sides thereof, disposed in a direction perpendicular to the rotating direction of the image bearing member or the contact charging member, each of the pair of shielding members being in the shape of a disk attached to the opposite ends of the image bearing member, with a larger diameter than a diameter of the image bearing member, or in the shape of a disk attached to the opposite ends of the contact charging member, with a larger diameter than a diameter of the contact charging member.

In the image formation apparatus, it is preferable that the nozzle of the non-ozone-generating gas supply member be directed to one of opposite end sides of the chargeable space so as to cause the non-ozone-generating gas to flow along the surface of the contact charging member and surface of the image bearing member within the chargeable space.

The image formation apparatus may further comprise a drive member for driving the contact charging member in rotation in a direction opposite to the rotating direction of the image bearing member.

The image formation apparatus may further comprise a pressure reduction member for reducing the pressure in the chargeable space.

In the image formation apparatus, the rotatable auxiliary space enclosure member may be in contact with one of a surface of the image bearing member or a surface of the contact charging member, with a gap between the rotatable auxiliary space enclosure and the image bearing member or with a gap between the rotatable auxiliary space enclosure and the contact charging member.

It is preferable that the non-ozone-generating gas for use in the image formation apparatus have a specific gravity greater than that of air, such as carbon dioxide.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Other features of this invention will become apparent in the course of the following description of exemplary embodiments, which are given for illustration of the invention and are not intended to be limiting thereof.

Figure 1A:
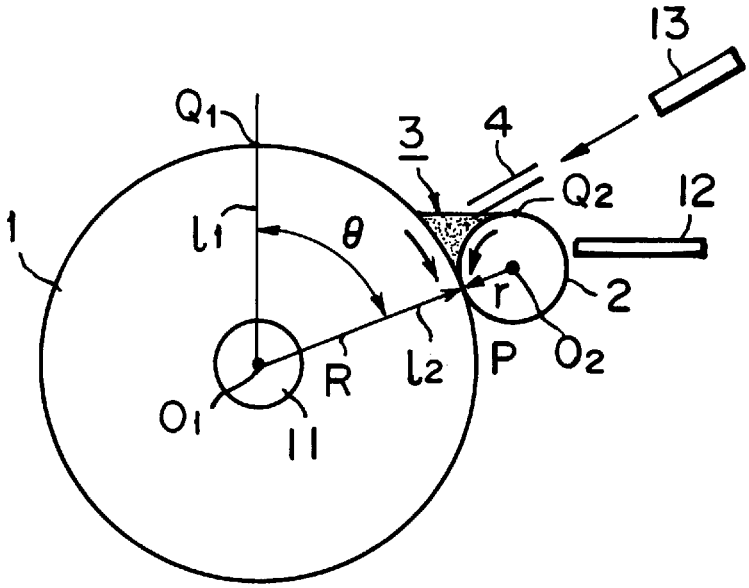
FIG. 1A is a schematic cross-sectional view of a main portion of a first example of an image formation apparatus, using a contact charging method, of the present invention.

Referring now to the drawings, wherein like reference numerals designate identical or corresponding parts throughout the several views, and more particularly to FIG. 1A thereof.

EXAMPLE 1

FIG. 1A is a schematic cross-sectional view of a main portion of a first example of an image formation apparatus, using a contact charging method, of the present invention.

In FIG. 1A, reference numeral 1 indicates a photoconductor drum serving as a chargeable member, and reference numeral 2 indicates a charging roller serving as a charging member.

In this image formation apparatus, the charging roller 2 is charged by charging means 12, and the thus charged charging roller 2 is in mutual rotation contact with the surface of the photoconductor drum 1 which is driven in rotation by drive means 11 such as a motor in a predetermined direction, for instance, in the direction of the arrow, at a predetermined constant speed, whereby corona charges are generated in a micro space formed between a surface of the photoconductor drum 1 and a surface of the charging roller 2, and the surface of the photoconductor drum 1 is uniformly charged.

In the course of the corona charging, a non-ozone-generating gas having a greater specific gravity than that of air, such as carbon dioxide ($CO_2$), is caused to stay in a chargeable space as indicated by reference numeral 3, so that the corona charging is conducted in the atmosphere of the non-ozone-generating gas. As shown in FIG. 1A, the chargeable space 3 extends from a contact position of the charging roller 2 with the photoconductor drum 1 and is positioned between a surface of the charging roller 2 and a surface of the photoconductor drum 1, with the surfaces facing each other, on an upstream side of the contact position with respect to the rotating direction of the charging roller 2, or the rotating direction of the photoconductor drum 1.

The non-ozone-generating gas is supplied to the chargeable space 3 from the above thereof through a gas supply pipe 4 by gas supply means 13 as illustrated in FIG. 1A.

The photoconductor drum 1 extends in a horizontal direction and is rotatable around a rotation center $O_1$ thereof and the charging roller 2 also extends in a horizontal direction, in parallel with the photoconductor drum 1, and is rotatable around a rotation center $O_2$ thereof, having substantially the same length as that of the photoconductor drum 1. In the example shown in FIG. 1A, the photoconductor drum 1 and the charging roller 2 are in such relative positions that an angle θ between (a) a line l1 which passes through a top point $Q_1$ of the photoconductor drum 1 and the rotation center $O_1$ of the photoconductor drum 1, that is, a vertical line which passes through the rotation center $O_1$ of the photoconductor drum 1, and (b) a line l2 which passes through the rotation center $O_1$ of the photoconductor drum 1 and a contact point P between the photoconductor drum 1 and the charging roller 2 is in a range of 30° to 90°. By disposing the photoconductor drum 1 and the charging roller 2 in such relative positions, a sufficient amount of the non-ozone-generating gas for preventing the generation of ozone can be securely caused to stay in the chargeable space 3 which is formed by the contact of the charging roller 2 with the photoconductor drum 1, so that corona charging can be carried out without generating ozone.

Figure 1B:
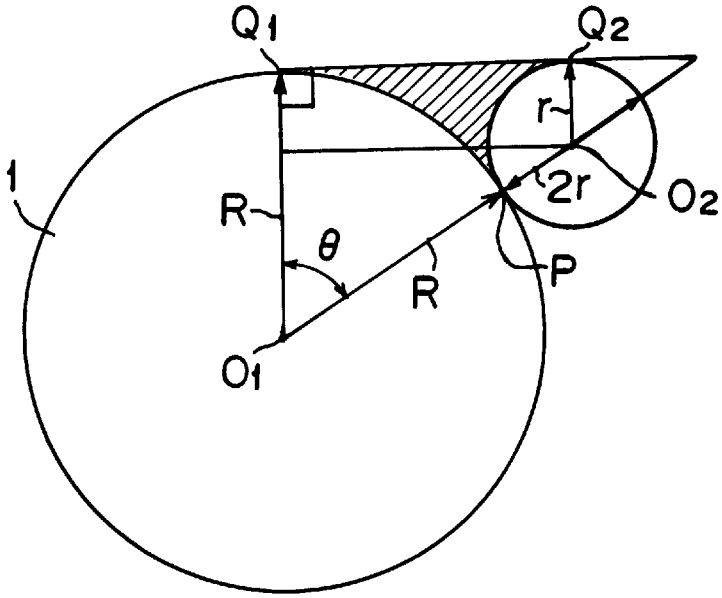
FIG. 1B is a schematic cross-sectional view of a chargeable space with a maximum capacity formed between a phtoconductor drum and a charging roller for use in the present invention.

The capacity of the chargeable space 3 to which the non-ozone-generating gas is supplied can be maximized when the above-mentioned angle θ satisfies the following formula (I) with reference to FIG. 1B:

$$\theta=\cos^{-1}(R-r)(R+r) \quad \text{(I)}$$

where R is the radius of the photoconductor drum 1 and r is the radius of the charging roller 2.

In this case, as shown in FIG. 1B, the top point $Q_1$ of the photoconductor drum 1 and a top point $Q_2$ of the charging roller 2 are at the same level.

Therefore, when the image formation apparatus is designed in such a manner that the relative positions and sizes of the photoconductor drum 1 and the charging roller 2 satisfy the above formula (I), the amount of the non-ozone-generating gas with which the chargeable space 3 can be filled can be securely maximized.

The chargeable space 3 can be filled with the non-ozone-generating gas by merely causing the non-ozone-generating gas to flow downward through the gas supply pipe 4, since the non-ozone-generating gas has a greater specific gravity than that of air.

In case the corona charging conditions are changed by the dissipation or dilution of the non-ozone-generating gas, the non-ozone-generating gas is supplied onto the external surface of the charging roller 2 by filling the chargeable space 3 with the non-ozone-generating gas to overflowing.

When the above image formation apparatus is employed, the surface of the photoconductor drum 1 can be properly charged by corona charging without generating ozone which is toxic by inhalation. Furthermore, an organic photoconductor is easily caused to deteriorate when exposed to ozone. However, even if such an organic photoconductor is used in the above-mentioned photoconductor drum 1, the deterioration of the organic photoconductor with ozone can be completely avoided, and the life of the photoconductor drum 1 can be extended.

Furthermore, as the non-ozone-generating gas, carbon dioxide is used, so that the generation of NOx components can be prevented and therefore the problem of the formation of abnormal images caused by the deposition of NOx components on the surface of the photoconductor drum 1 can be completely avoided.

EXAMPLE 2

Figure 2A:
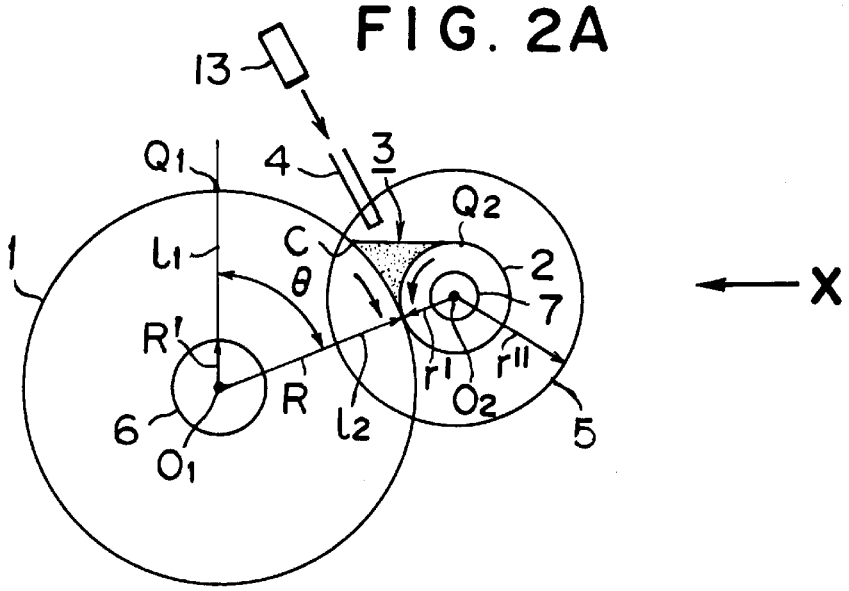
FIG. 2A is a schematic cross-sectional side view of a main portion of a second example of an image formation apparatus, using a contact charging method, of the present invention.

FIG. 2A is a schematic cross-sectional side view of a main portion of a second example of an image formation apparatus, using a contact charging method, of the present invention.

Figure 2B:
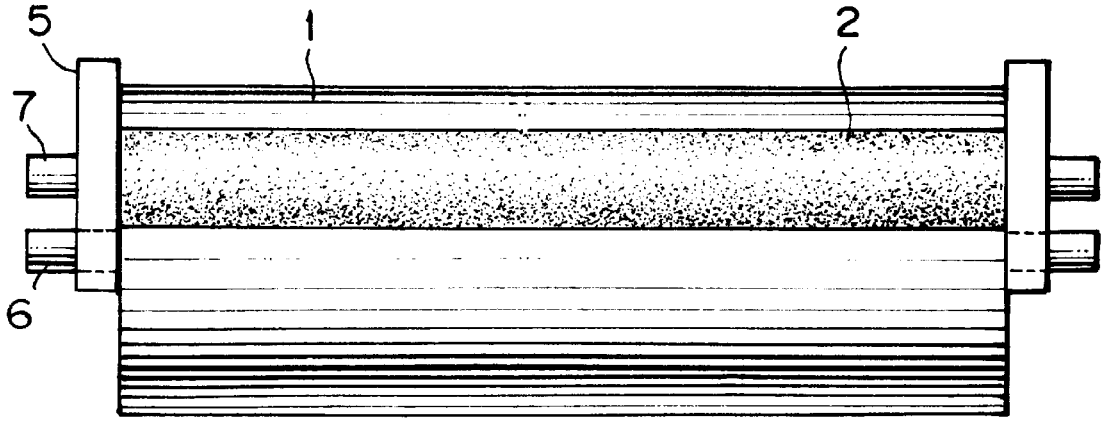
FIG. 2B is a schematic front view of the second example of the image formation apparatus as shown in FIG. 2A, when viewed in the direction of the arrow X in FIG. 2A.

FIG. 2B is a schematic front view of the second example of the image formation apparatus as shown in FIG. 2A, when viewed in the direction of the arrow X in FIG. 2A.

In FIG. 2A, reference numeral 1 indicates a photoconductor drum serving as a chargeable member, and reference numeral 2 indicates a charging roller serving as a charging member.

In this image formation apparatus, the charging roller 2 is charged by the same charging means (not shown) as the charging means 11 in the first example of the image formation apparatus in Example 1, and the thus charged charging roller 2 is in mutual rotation contact with the surface of the photoconductor drum 1 which is driven in rotation by the same drive means (not shown) as the drive means 11 such as a motor in the first example of the image formation apparatus in Example 1, in a predetermined direction, for instance, in the direction of the arrow, at a predetermined constant speed, whereby corona charges are generated in a micro space formed between a surface of the photoconductor drum 1 and a surface of the charging roller 2, and the surface of the photoconductor drum I is uniformly charged.

In the course of the corona charging, a non-ozone-generating gas having a greater specific gravity than that of air, such as carbon dioxide ($CO_2$a), is caused to stay in the same chargeable space 3 as in the first example of the image formation apparatus in Example 1, so that the corona charging is conducted in the atmosphere of the non-ozone-generating gas.

The non-ozone-generating gas is supplied to the chargeable space 3 from the above thereof through a gas supply pipe 4 by gas supply means 13 as illustrated in FIG. 2A.

The photoconductor drum 1 extends in a horizontal direction, is fixedly mounted on a shaft 6 and rotatable around a rotation center $O_1$ thereof and the charging roller 2 also extends in a horizontal direction, in parallel with the photoconductor drum 1, is fixedly mounted on a shaft 7 and rotatable around a rotation center $O_2$ thereof, having the same length as that of the photoconductor drum 1.

In the second example shown in FIGS. 2A and 2B, a pair of shielding members 5 for shielding the chargeable space at opposite sides thereof are disposed in a direction perpendicular to the rotating direction of the charging member 2 in such a manner that the shielding members 5 are fixed to the opposite sides of the charging member 2 coaxially with the shaft 7 of the charging member 2. Each of the pair of shielding members 5 is in the shape of a disk having a larger diameter than the diameter of the charging member 2, but is out of contact with the shaft 6 of the photoconductor drum 1, and covers a cross point C of a horizontal line which touches a top point $Q_2$ of the charging member 2 with the circumference of the cross section of the photoconductor drum 1 as shown in FIG. 2A.

In other words, in this image formation apparatus, the above-mentioned shielding members 5 are designed so as to satisfy the following formula (II):

$$R-R'+r>r''\geqq r/\sin[\theta-\cos^{-1}((1+r/R)\cos\theta+r/R)] \quad \text{(II)}$$

where R is the radius of the photoconductor drum 1, r is the radius of the charging roller 2, R' is the radius of the shaft 6 of the photoconductor drum 1, r" is the radius of the shielding member 5, and θ is an angle between (a) a vertical line l1 which passes through the rotation center $O_1$ of the photoconductor drum 1 and (b) a line l2 which passes through the rotation center $O_1$ of the photoconductor drum 1 and the rotation center $O_2$ Of the charging roller 2.

By designing each of the above-mentioned elements, with the provision of the shielding members 5, so as to satisfy the above formula (II), the dissipation of the non-ozone-generating gas from the opposite ends of the chargeable space 3 can be effectively prevented and the non-ozone-generating gas can be used efficiently, without the rotation of the charging roller 2 being hindered with the shielding members 5.

Furthermore, the above-mentioned angle θ between (a) the vertical line l1 which passes through the rotation center $O_1$ of the photoconductor drum 1 and (b) the line l2 which passes through the rotation center $O_1$ of the photoconductor drum 1 and the rotation center $O_2$ of the charging roller 2 is in the range of 30° to 90°.

By disposing the photoconductor drum 1 and the charging roller 2 in such relative positions, a sufficient amount of the non-ozone-generating gas for preventing the generation of ozone can be securely caused to stay in the chargeable space 3, so that corona charging can be carried out without generating ozone.

The capacity of the chargeable space 3 can be maximized when the above-mentioned angle θ satisfies the above-mentioned formula (I).

In this case, the top point $Q_1$ of the photoconductor drum 1 and the top point $Q_2$ of the charging roller 2 are at the same level.

Therefore, when the image formation apparatus is designed in such a manner that the relative positions and sizes of the photoconductor drum 1 and the charging roller 2 satisfy the above formula (I), the amount of the non-ozone-generating gas with which the chargeable space 3 can be filled can be securely maximized.

The chargeable space 3 can be filled with the non-ozone-generating gas by merely causing the non-ozone-generating gas to flow downward through the gas supply pipe 4, since the non-ozone-generating gas has a greater specific gravity than that of air.

In case the corona charging conditions are changed by the dissipation or dilution of the non-ozone-generating gas, the non-ozone-generating gas is supplied onto the external surface of the charging roller 2 by filling the chargeable space 3 with the non-ozone-generating gas to overflowing.

When the above image formation apparatus is employed, the surface of the photoconductor drum 1 can be properly charged by corona charging without generating ozone which is toxic by inhalation. An organic photoconductor is easily caused to deteriorate when exposed to ozone. However, even if such an organic photoconductor is used in the above-mentioned photoconductor drum 1, the deterioration of the organic photoconductor with ozone can be completely avoided, and the life of the photoconductor drum 1 can be extended.

Furthermore, as the non-ozone-generating gas, carbon dioxide is used, so that the generation of NOx components can be prevented and therefore the problem of the formation of abnormal images caused by the deposition of NOx components on the surface of the photoconductor drum 1 can be completely avoided.

In the above image formation apparatus, the shielding members 5 are provided on the opposite ends of the charging roller 2. However, the shielding members 5 may also be provided on the opposite ends of the photoconductor drum 1. In such a case, it is necessary that the shielding members 5 be designed in such a manner that the shielding members 5 do not touch the shaft 7 for the charging roller 2.

EXAMPLE 3

Figure 3A:
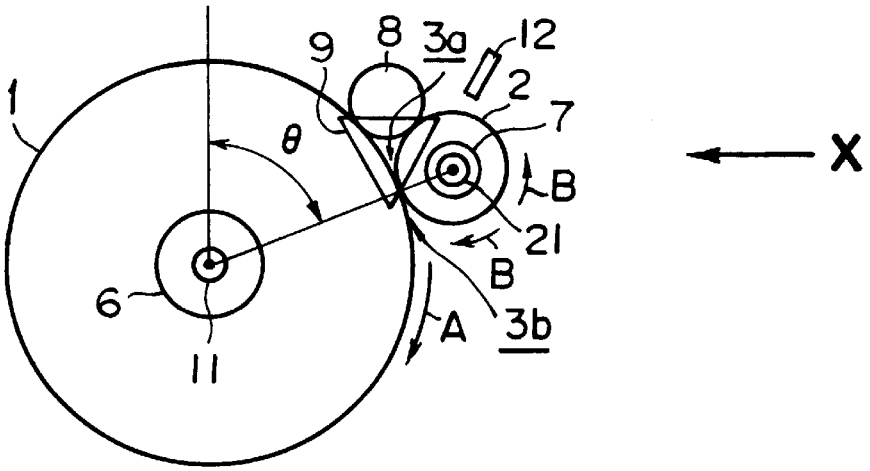
FIG. 3A is a schematic cross-sectional side view of a main portion of a third example of an image formation apparatus, using a contact charging method, of the present invention.

FIG. 3A is a schematic cross-sectional side view of a main portion of a third example of an image formation apparatus, using a contact charging method, of the present invention.

Figure 3B:
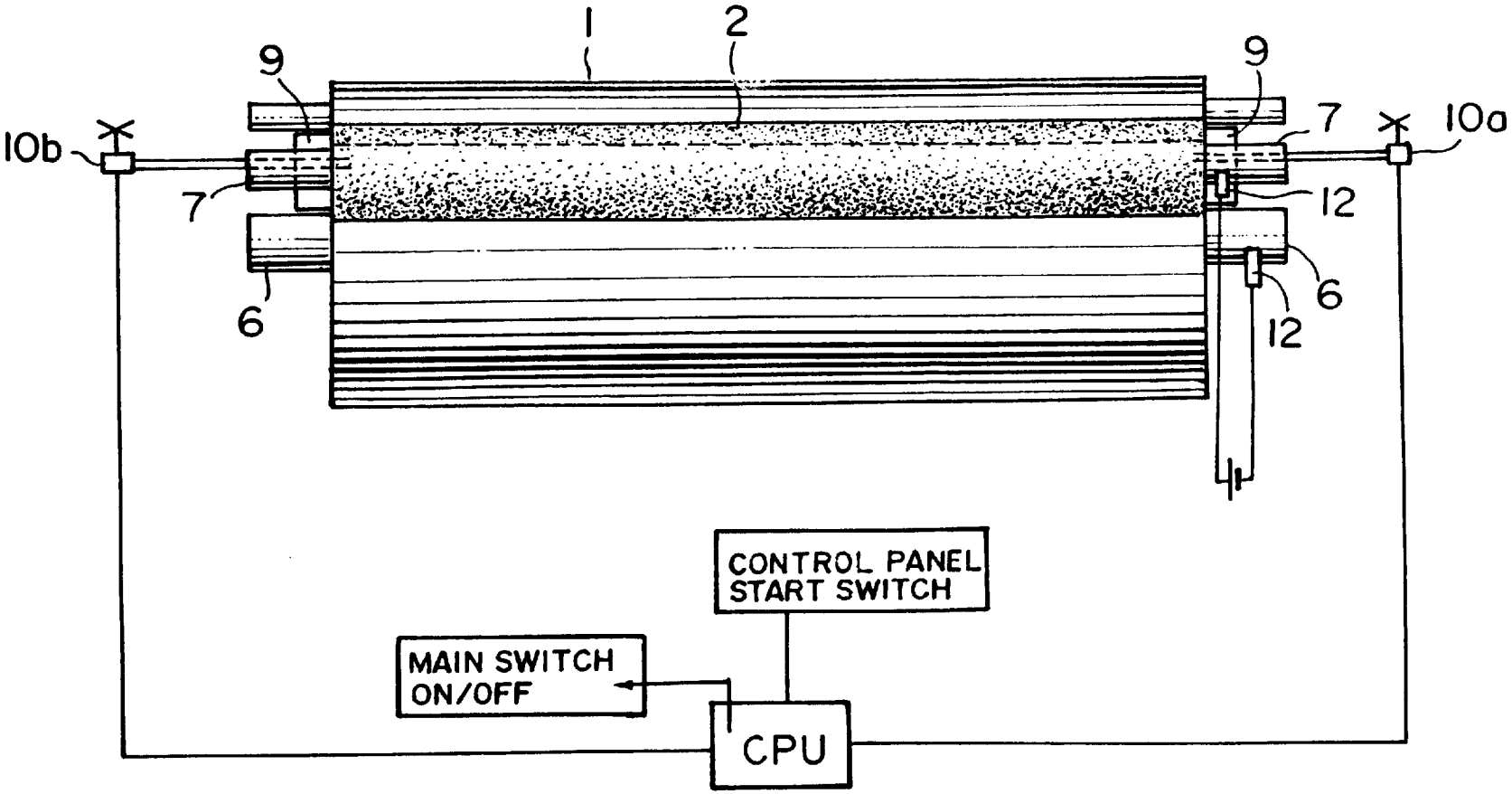
FIG. 3B is a schematic front view of the third example of the image formation apparatus as shown in FIG. 3A, when viewed in the direction of the arrow X in FIG. 3A.

FIG. 3B is a schematic front view of the third example of the image formation apparatus as shown in FIG. 3A, when viewed in the direction of the arrow X in FIG. 3A.

In FIG. 3A, reference numeral 1 indicates a photoconductor drum serving as a chargeable member which is driven in rotation in a predetermined direction of the arrow A at a predetermined speed by drive means 11, and reference numeral 2 indicates a charging roller serving as a charging member which is driven in rotation in the direction of the arrow 3 by drive means 21, which direction is the same as the rotating direction of the photoconductor drum 1.

In this image formation apparatus, the charging roller 2 is charged by charging means 12 and the thus charged charging roller 2 is in rotation contact with the surface of the photoconductor drum 1, whereby corona charges are generated in a micro space formed between a surface of the photoconductor drum 1 and a surface of the charging roller 2, and the surface of the photoconductor drum 1 is uniformly charged.

In the course of the corona charging, the non-ozone-generating gas is supplied to a chargeable space 3*a* which is substantially the same as in the first example of the image formation apparatus in Example 1, so that the corona charging is conducted in the atmosphere of the non-ozone-generating gas.

The non-ozone-generating gas is supplied to the chargeable space 3*a*, using a gas injection valve 10*a*, and is caused to flow through the chargeable space 3*a* and discharged therefrom, using a gas discharge valve 10*b*, as shown in FIG. 3B.

The photoconductor drum 1 extends in a horizontal direction, is fixedly mounted on a shaft 6 and driven in rotation thereon, and the charging roller 2 also extends in a horizontal direction, in parallel with the photoconductor drum 1, is fixedly mounted on a shaft 7 and driven in rotation thereon.

In this third example of the image formation apparatus shown in FIGS. 3A and 3B, a rotatable member 8 is disposed above the chargeable space 3*a* in contact with the photoconductor drum 1 and the charging roller 2 in such a manner as to be rotated, following the rotation of the photoconductor drum 1 or the charging roller 2.

Furthermore, a pair of shielding members 9 for shielding the chargeable space 3*a* at opposite sides thereof are also disposed in order to prevent the dissipation of the non-ozone-generating gas from the opposite sides of the chargeable space 3*a*.

By the provision of the rotatable member 8 and the shielding members 9, the chargeable space 3*a* can be sealed, and the dissipation of the non-ozone-generating gas from the opposite ends of the chargeable space 3*a* can be effectively prevented and the non-ozone-generating gas can be used efficiently, with the prevention of the dissipation of zone and NOx components, if any, to the outside.

Since the rotatable member 8 is rotatable in contact with the photoconductor drum 1 and the charging roller 2, following the rotation thereof, no drive means is necessary for the rotatable member 8.

Furthermore, the potential of the rotatable member 8 is set at such a potential that is the same potential as that of a charging portion of the charging roller 2, or at a potential less than that of the charging portion of the charging roller 2, but at a potential which is not less than the potential of the surface of the photoconductor drum 1. By maintaining the relationship of the potentials of the rotatable member 8, the charging roller 2 and the photoconductor drum 1, the occurrence of charging from the charging roller 2 to the rotatable member 8 can be controlled, and if such charging takes place, the photoconductor drum 1 can be prevented from being charged by the potential of the rotatable member 8, so that the charging from the charging roller 2 to the photoconductor drum 1 can be caused in a stable manner, and therefore the photoconductor 1 can be charged in a stable manner.

The non-ozone-generating gas is supplied to the chargeable space 3*a* through a gas supply pipe (not shown) which pass through the shielding member 9, and is then discharged from a gas discharge pipe (not shown) which also passes through the shielding member 9, with the pressure in the chargeable space 3*a* being reduced. The reduction of the pressure in the chargeable space 3*a* facilitates the charging between the surface of the photoconductor drum 1 and the surface of the charging roller 2, so that the application of charges to the surface of the photoconductor drum 1 can be performed efficiently.

The pressure in the above-mentioned chargeable space 3*a* can be determined by Paschen's law. More specifically, according to Paschen's law, a charging initiation voltage V is a function of a product of a pressure P in the atmosphere and a distance d between electrodes, that is, a function of the product P·d. The charging initiation voltage V increases when the product P·d increases or decreases, having a minimal value at a certain product P·d. With respect to the charging initiation voltage V, the pressure P is inversely proportional to the distance d, so that when the pressure P increases, the distance g decreases. Therefore, the pressure P can be determined in accordance with the distance d that has to be secured when conducting corona charging. For instance, in the case of air, it is when the product P·d is 5 mm·mmHg that a charging initiation voltage of 310 [V] (V=310[V]) can be attained, so that when it is desired to set the distance at 5 mm, the pressure P should be set at 1 mmHg.

Thus, in the above-mentioned third example of the image formation apparatus of the present invention, the upper chargeable space 3*a* formed by the contact of the photoconductor drum 1 and the charging roller 3 can be sealed as mentioned above, and corona charging is carried out in the atmosphere of the non-ozone-generating gas in the sealed chargeable space 3*a*, so that even when air or oxygen is used as the non-ozone-generating gas, generated ozone does not come out of the chargeable space 3*a*. However, it may occur that the gastightness of the chargeable space 3*a* decreases with time, so that it is preferable that non-ozone-generating gases such as carbon dioxide and argon gas, in the presence of which no ozone is generated, be employed. When carbon dioxide or argon gas is employed as the non-ozone-generating gas, the generation of NOx components can be prevented and therefore the problem of the formation of abnormal images caused by the deposition of NOx components on the surface of the photoconductor drum 1 can be completely avoided.

Furthermore, in the above-mentioned third example of the image formation apparatus of the present invention, the non-ozone-generating gas is caused to stay in the sealed upper chargeable space 3*a*. A lower chargeable space 3*b* can also be used in the same manner as the upper chargeable space 3*a* is used, if the lower chargeable space 3*b* is sealed and filled with the non-ozone-generating gas in the same manner as in the upper chargeable space 3*a*.

Furthermore, in the above-mentioned third example of the image formation apparatus of the present invention, the photoconductor drum 1 and the charging roller 2 are rotated in the same direction. However, the charging roller 2 may be rotated in the opposite direction to that of the photoconductor drum 1, that is, in the direction of the arrow B'. In such a case, it is preferable that the rotatable member 8 be rotated forcibly in one direction.

With reference to FIG. 3B, the above-mentioned third example of the image formation apparatus of the present invention can actually be operated as follows:

When the "start switch" in the control panel is depressed, the gas injection valve 10*a* is opened and the non-ozone-generating gas is supplied to the chargeable space 3*a* before the surface of the photoconductor drum 1 is charged by the charging roller 2 through the charging means 12. After the chargeable space 3*a* is filled with the non-ozone-generating gas, the gas injection valve 10*a* is closed. In the course of the corona charging which is successively conducted, the concentration of the non-ozone-generating gas in the chargeable space 3*a* is monitored by a gas concentration sensor (not shown) and if the concentration decreased below a predetermined level, the gas injection valve 10*a* is automatically opened and the non-ozone-generating gas is replenished to the chargeable space 3*a*.

When a copy-making operation is finished, the gas discharge valve 10*b* is opened so that the non-ozone-generating gas is discharged from the chargeable space 3*a*. The gas discharging operation may also be started with the "main switch" is turned off.

Figure 3C:
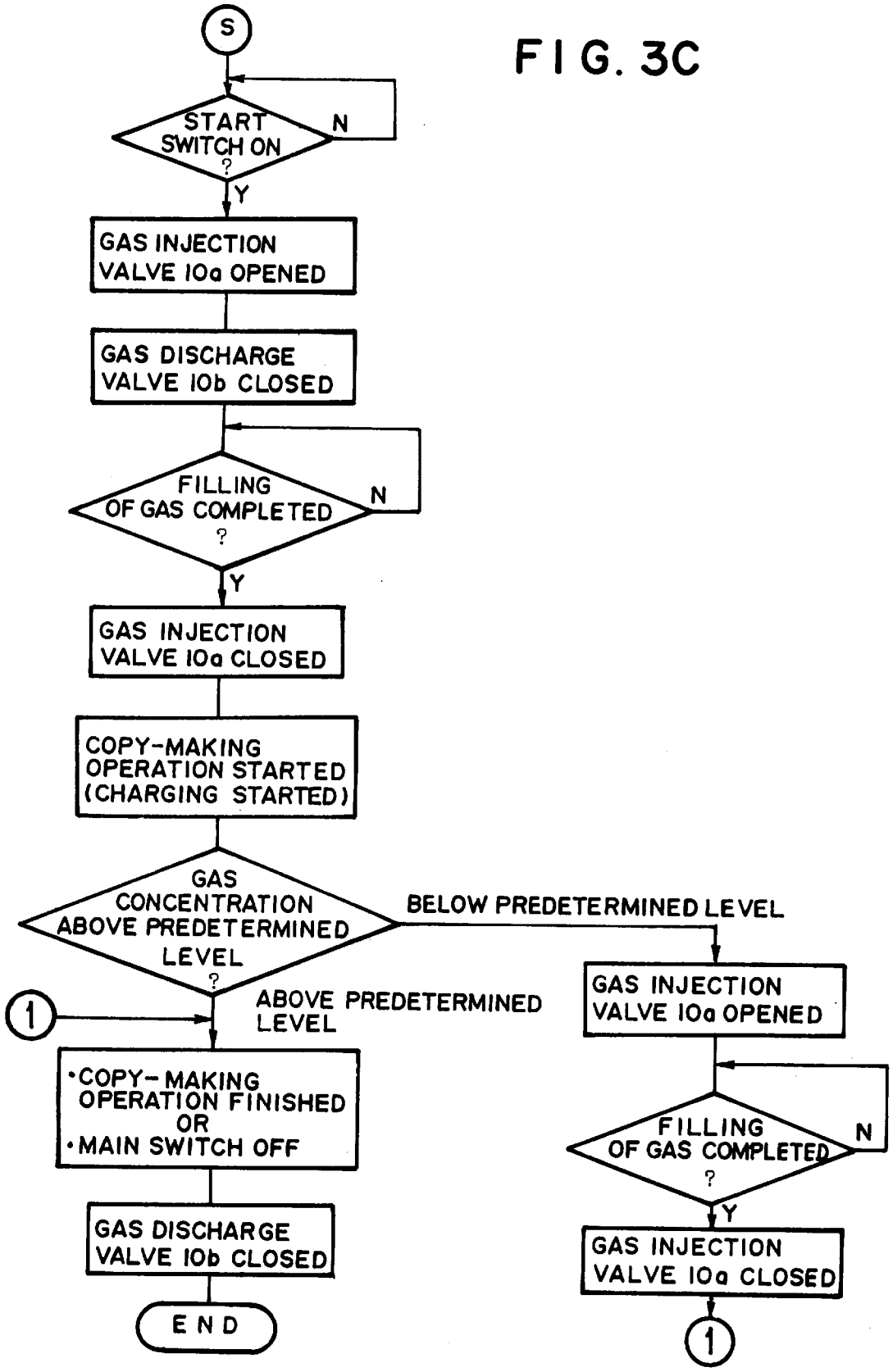
FIG. 3C is a block diagram in explanation of the operation of the third example of the image formation apparatus as shown in FIG. 3A.

The above steps are shown in more detail in a block diagram in FIG. 3C.

EXAMPLE 4

Figure 4A:
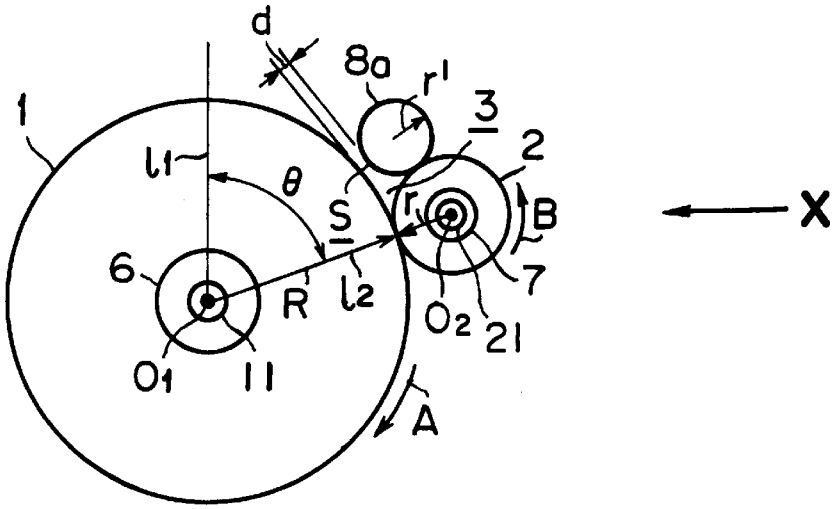
FIG. 4A is a schematic cross-sectional side view of a main portion of a fourth example of an image formation apparatus, using a contact charging method, of the present invention.

FIG. 4A is a schematic cross-sectional side view of a main portion of a fourth example of an image formation apparatus, using a contact charging method, of the present invention.

Figure 4B:
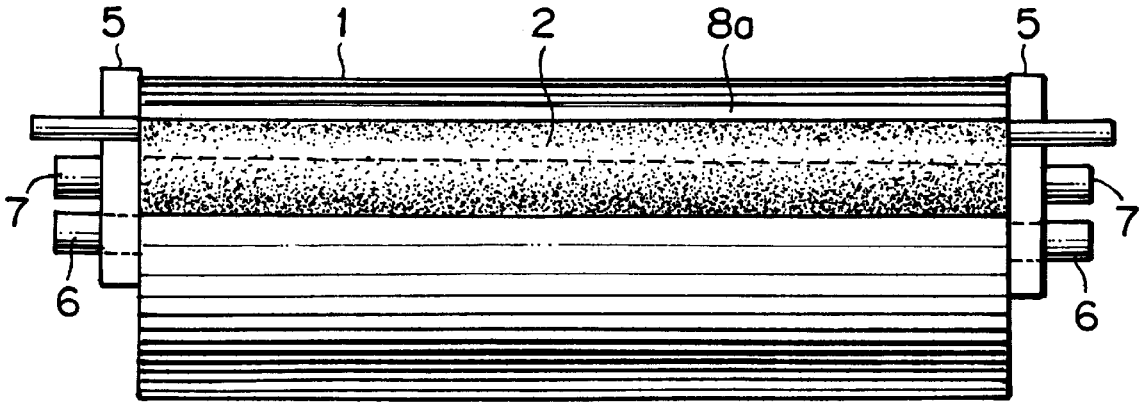
FIG. 4B is a schematic front view of the fourth example of the image formation apparatus as shown in FIG. 4A, when viewed in the direction of the arrow X in FIG. 4A.

FIG. 4B is a schematic front view of the fourth example of the image formation apparatus as shown in FIG. 4A, when viewed in the direction of the arrow X in FIG. 4A.

In FIG. 4A, reference numeral 1 indicates a photoconductor drum serving as a chargeable member which is driven in rotation in a predetermined direction of the arrow A at a predetermined speed by drive means 11, and reference numeral 2 indicates a charging roller serving as a charging member which is driven in rotation in the direction of the arrow B by drive means 21, which direction is opposite to the rotating direction of the photoconductor drum 1.

In this image formation apparatus, the charging roller 2 is charged by charging means (not shown) and the thus charged charging roller 2 is in rotation contact with the surface of the photoconductor drum 1, whereby corona charges are generated in a micro space formed between a surface of the photoconductor drum 1 and a surface of the charging roller 2, and the surface of the photoconductor drum 1 is uniformly charged.

In the course of the corona charging, the non-ozone-generating gas is supplied to a chargeable space 3 which is substantially the same as in the first example of the image formation apparatus in Example 1, by gas supply means (not shown), so that the corona charging is conducted in the atmosphere of the non-ozone-generating gas. As the non-ozone-generating gas, carbon dioxide which has a greater specific gravity than that of air is employed in this example of the image formation apparatus of the present invention.

The photoconductor drum 1 extends in a horizontal direction, is fixedly mounted on a shaft 6 and driven in rotation thereon, and the charging roller 2 also extends in a horizontal direction, in parallel with the photoconductor drum 1, is fixedly mounted on a shaft 7 and driven in rotation thereon. The photoconductor drum 1 and the charging roller 2 are substantially the same in length.

In this fourth example of the image formation apparatus, a pair of shielding members 5 for shielding the chargeable space 3 at opposite sides thereof are disposed in a direction perpendicular to the rotating direction of the charging member 2 in such a manner that the shielding members 5 are fixed to the opposite sides of the charging member 2 coaxially with the shaft 7 of the charging member 2 as shown in FIG. 4B.

Furthermore, a rotatable member 8*a* is disposed above the chargeable space 3 in contact with the charging roller 2 in such a manner as to be rotated, following the charging roller 2. The rotatable member 8*a* and the charging roller 2 are substantially the same in length, the radius r' of the rotatable member 8*a* is smaller than the radius r of the charging roller 2.

As mentioned above, in this example of the image formation apparatus of the present invention, carbon dioxide is employed as the non-ozone-generating gas, and in order to minimize the charge from the surface of the rotatable member 8*a* from the surface of the photoconductor drum 1, a minimum distance or gap d between the rotatable member 8*a* and the photoconductor 1 is set at 0.007 mm, not less than 0.007 mm. This minimum distance was calculated from a data concerning a sparking voltage and parallel electrodes in a corona charging area in an atmosphere of carbon dioxide at a pressure of 760 mmHg, with the sparking voltage thereof being 410 V when the previously mentioned product P·d (gap length×atmospheric pressure) is 5 mm·mmHg, so that the gap length is 5 mm·mmHg/760 mmHg=0.0066 mm, with reference to "Denri Kitairon (Theory of Ionized Gases)" published by Denki Gakkai in Japan in 1969.

By the provision of the rotatable member 8*a* in the above-mentioned manner, the upper portion of the chargeable space 3 is almost completely closed, provided that there remains a small gap a between the photoconductor drum 1 and the rotatable member 8*a* as illustrated in FIG. 4A, so that the dissipation of the non-ozone-generating gas from the chargeable space 3 can be effectively prevented and the non-ozone-generating gas can be used efficiently.

Since the rotatable member 8*a* is rotatable in contact with the charging roller 2, following the rotation thereof, no drive means is necessary for the rotatable member 8*a*.

The non-ozone-generating gas c an be supplied to the chargeable space 3 through the gap s between the rotatable member 8*a* and the photoconductor drum 1 just by causing the non-ozone-generating gas to flow.

The chargeable space 3 can be filled with the non-ozone-generating gas by merely causing the non-ozone-generating gas to flow downward through the gas supply pipe 4, since the non-ozone-generating gas has a greater specific gravity than that of air.

In case the corona charging conditions are changed by the dissipation or dilution of the non-ozone-generating gas, the non-ozone-generating gas is supplied onto the external surface of the charging roller 2 by filling the chargeable space 3 with the non-ozone-generating gas to overflowing.

When the above image formation apparatus is employed, the surface of the photoconductor drum 1 can be properly charged by corona charging without generating ozone which is toxic by inhalation. An organic photoconductor is easily caused to deteriorate when exposed to ozone. However, even if such an organic photoconductor is used in the above-mentioned photoconductor drum 1, the deterioration of the organic photoconductor with ozone can be completely avoided, and the life of the photoconductor drum 1 can be extended.

Furthermore, as the non-ozone-generating gas, carbon dioxide is used, so that the generation of NOx components can be prevented, and therefore the problem of the formation of abnormal images caused by the deposition of NOx components on the surface of the photoconductor drum 1 can be completely avoided.

In the above image formation apparatus, the shielding members 5 are provided on the opposite ends of the charging roller 2. However, the shielding members 5 may also be provided on the opposite ends of the photoconductor drum 1. In such a case, it is necessary that the shielding members 5 be designed in such a manner that the shielding members 5 do not touch the shaft 7 for the charging roller 2.

Also in this image formation apparatus, if the corona charging conditions are changed by the dissipation or dilution of the non-ozone-generating gas, the non-ozone-generating gas is supplied onto the external peripheral surface of the charging roller 2 by filling the chargeable space 3 with the non-ozone-generating gas to overflowing.

In this image formation apparatus, the rotatable member 8*a* is in contact with the charging roller 2, so that both are at the same potential. Therefore, no charging takes place between the rotatable member 8*a* and the charging roller 2, so that the charging of the photoconductor drum 1 by the charging roller 2 can be performed in a stable manner.

Furthermore, as mentioned above, the minimum gap between the surface of the rotatable member 8*a* and the surface of the photoconductor drum 1 is set at 0.007 mm or more, so that the charging from the rotatable member 8*a* to the photoconductor drum 1 hardly takes place, and therefore the charging of the photoconductor drum 1 by the charging roller 2 can be performed in a stable manner in this respect as well.

EXAMPLE 5

In the first example of the image formation apparatus in Example 1, a photoconductor drum 1 with a diameter of 40 mm, and a charging roller 2 with a diameter of 15 mm were employed.

The angle θ between (a) the vertical line l1 which passes through the rotation center $O_1$ of the photoconductor drum 1 and (b) the line l2 which passes through the rotation center $O_1$ of the photoconductor drum 1 and the rotation center $O_2$ of the charging roller 2, by which the positional relationship between the photoconductor drum 1 and the charging roller 2 is determined, was varied. In accordance with the change of the angle θ, the layout of an exposure section, a development section, an image transfer section, and an image fixing section was slightly changed.

With the chargeable space 3 filled with carbon dioxide, the photoconductor drum 1 was subjected to corona charging by the charging roller 2, and image formation was conducted with a series of image formation processes including exposure, development, image transfer and image fixing.

The results were as follows:

TABLE 1

| Angle θ | Charge Current | Image Quality | Supply of Carbon Dioxide ($CO_2$) | Concentration of Ozone ($O_3$) Discharged |
|---|---|---|---|---|
| 0* | Greatly varied | Unstable | Constant Supply Required | 0.008 ppm |
| 10° | Greatly varied | Unstable | Constant Supply Required | 0.005 ppm |
| 30° | Slightly varied | Good | Intermittent Supply Possible | not more than 0.0005 ppm |
| 45° | Stable | Good | Intermittent Supply Possible | not more than 0.0005 ppm |

TABLE 1-continued

| Angle θ | Charge Current | Image Quality | Supply of Carbon Dioxide ($CO_2$) | Concentration of Ozone ($O_3$) Discharged |
|---|---|---|---|---|
| 60° | Stable | Good | Intermittent Supply Possible | not more than 0.0005 |
| 63°* | Stable | Good | Intermittent Supply Possible | not more than 0.0005 ppm |
| 90° | Stable | Good | Intermittent Supply Possible | not more than 0.0005 ppm |
| 120° | Greatly Varied | Unstable | Constant Supply Required | 0.008 ppm |
| 180° | Greatly Varied | Unstable | Constant Supply Required | 0.008 ppm |

*$\theta = \cos^{-1}(R - r)/(R + r) = \cos^{-1}(40 - 15)/(40 + 15) = \cos^{-1}(0.4545) = 63°$ The above results indicate that when the angle θ was in the range of 30° to 90°, good quality images were obtained, in particular, when the angle θ was about 63°, a good image was obtained, at which the capacity of the chargeable space 3 was maximized.

EXAMPLE 6

The same procedure as in Example 5 was repeated, using the same image formation apparatus as used in Example 5, except that the carbon dioxide employed in Example 5 as the non-ozone-generating gas was replaced by argon gas.

The result was that when the angle θ was about 63°, a good image was also obtained even when argon gas was employed as the non-ozone-generating gas instead of carbon dioxide.

EXAMPLE 7

In the second example of the image formation apparatus in Example 2, a photoconductor drum 1 with a diameter of 40 mm, and a charging roller 2 with a diameter of 15 mm, both of which were of the same length, were employed.

A pair of shielding members 5 in the shape of a disk having a diameter of 20 mm for shielding the chargeable space at opposite sides thereof were fixed to the opposite sides of the charging member 2 coaxially with the shaft 7 of the charging member 2.

With carbon dioxide being supplied to the chargeable space 3, corona charges were generated in a micro space formed between a surface of the photoconductor drum 1 and a surface of the charging roller 2, and the surface of the photoconductor drum 1 was uniformly charged, and image formation was conducted with a series of image formation processes including exposure, development, image transfer and image fixing.

The result was that the dissipation of carbon dioxide from the chargeable space 3 was significantly reduced and excellent images were formed for an extended period of time, in contrast to the case where the shielding members 5 were not used.

EXAMPLE 8

In the third example of the image formation apparatus in Example 3, a photoconductor drum 1 with a diameter of 40 mm, a charging roller 2 with a diameter of 15 mm, and a rotatable member 8 having a diameter of 10 mm, which were of the same length, were employed.

The chargeable space 3 surrounded by the above three members 1, 2 and 8 was also enclosed by a pair of shielding members 9 for shielding the chargeable space 3 at opposite sides thereof.

With carbon dioxide being supplied to the chargeable space 3 from a gas inlet and outlet hole formed in the shielding members 9 and also with the reduction of the pressure in the chargeable space 3 to about 30 mmHg, corona charges were generated in a micro space formed between the surface of the photoconductor drum 1 and the surface of the charging roller 2, and the surface of the photoconductor drum 1 was uniformly charged, and image formation was conducted with a series of image formation processes including exposure, development, image transfer and image fixing.

The result was that excellent images were formed.

EXAMPLE 9

The procedure in Example 8 was repeated, using the same image formation apparatus as used in Example 8, provided that the air in the chargeable space 3 was not replaced with carbon dioxide, but the air was remained therein with the pressure reduced to about 30 mnHg.

Thus, corona charges were generated in a micro space formed between the surface of the photcconductor drum 1 and the surface of the charging roller 2, and the surface of the photoconductor drum 1 was uniformly charged, and image formation was conducted with a series of image formation processes including exposure, development, image transfer and image fixing.

The result was that excellent images were formed.

COMPARATIVE EXAMPLE

The procedure in Example 8 was repeated, using the same image formation apparatus as used in Example 8, provided that the air in the chargeable space 3 was not replaced with carbon dioxide, but the air was remained therein, and the pressure in the chargeable space 3 was not reduced.

Thus, corona charges were generated in a micro space formed between the surface of the photoconductor drum 1 and the surface of the charging roller 2, and the surface of the photoconductor drum 1 was uniformly charged, and image formation was conducted with a series of image formation processes including exposure, development, image transfer and image fixing.

The result was that fogging was observed in the images obtained. In order to obtain images with good quality, the applied voltage had to be increased. When the voltage was increased for this purpose, the concentration of ozone generated was increased to more than 10 times the concentration of formed in Example 8, although there was no pungent odor of ozone around the image formation apparatus.

In the above-mentioned examples, the photoconductor 1 is in the shape of a drum, and the charging roller 2 is in the shape of a roller. However, the photoconductor drum 1 may be replaced by an endless-belt shaped photoconductor, and the charging roller 2 also may be replaced by an an endless-belt shaped charging member. Accordingly, the photoconductor drum 1 may be used in combination with the endless-belt shaped charging member. The endless-belt shaped photoconductor may be used in combination with the charging roller 2 or with the endless-belt shaped charging member.

Figure 5A:
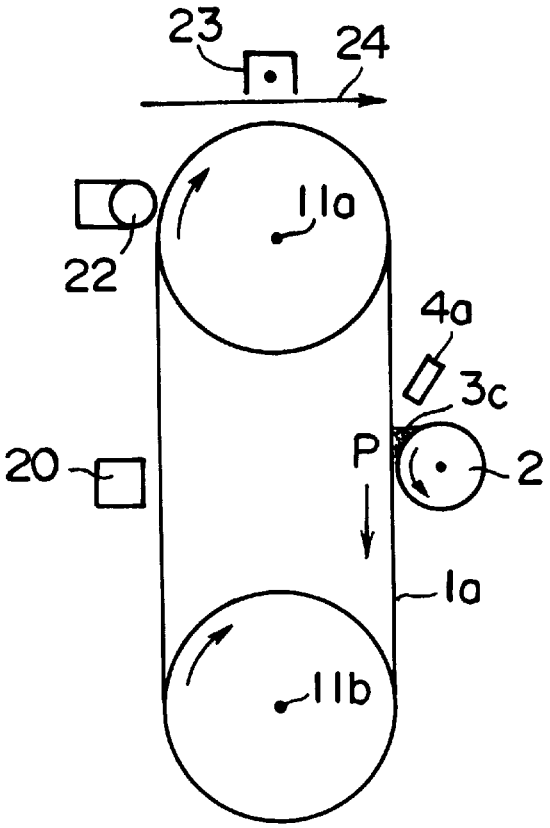
FIG. 5A is a diagram of the combination of an endless-belt shaped photoconductor la and the charging roller 2.

More specifically, FIG. 5A is a diagram of the combination of an endless-belt shaped photoconductor 1*a* and the charging roller 2. In this combination, the endless-belt shaped photoconductor 1*a* is positioned vertically, so that a chargeable space 3*c* which holds the non-ozone-generating gas can be easily formed. In FIG. 5A, reference numeral 4*a* indicates a nozzle for supplying the non-ozone-generating gas to the chargeable space 3*c*. The charging roller 2 is rotated in the direction of the arrow in contact with the endless-belt shaped photoconductor 1*a* at a contact point P. The endless-belt shaped photoconductor la is driven in rotation by a pair of drive means 11*a* and 11*b*. Reference numeral 20 indicates exposure means; reference numeral 22, development means; reference numeral 23, image transfer means; and reference numeral 24, a transfer sheet to which developed images are transferred and fixed.

Figure 5B:
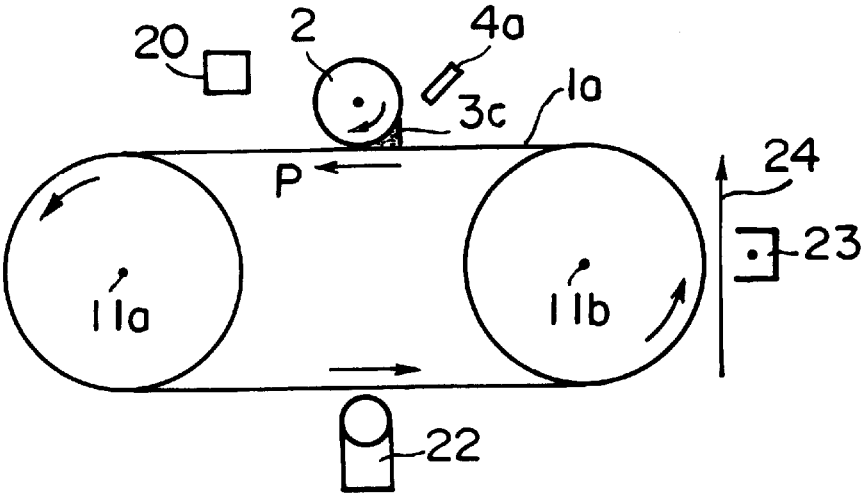
FIGS. 5B and 5C are diagrams of other examples of the combinations of the endless-belt shaped photoconductor la and the charging roller 2.
Figure 5C:
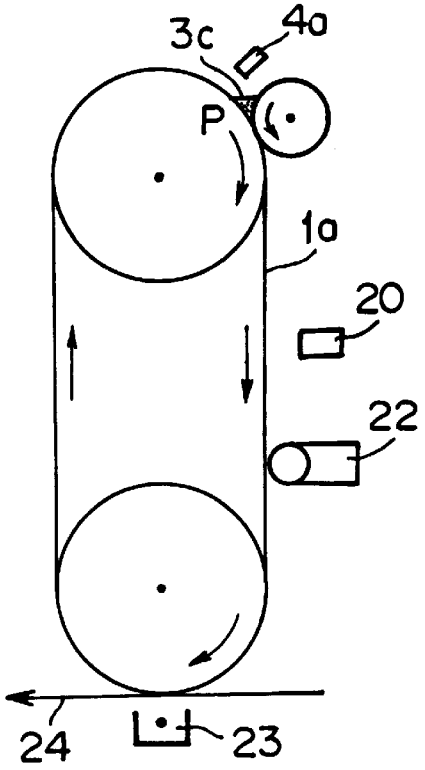

FIGS. 5B and 5C show other examples of the combinations of the endless-belt shaped photoconductor 1*a* and the charging roller 2.

Figure 6A:
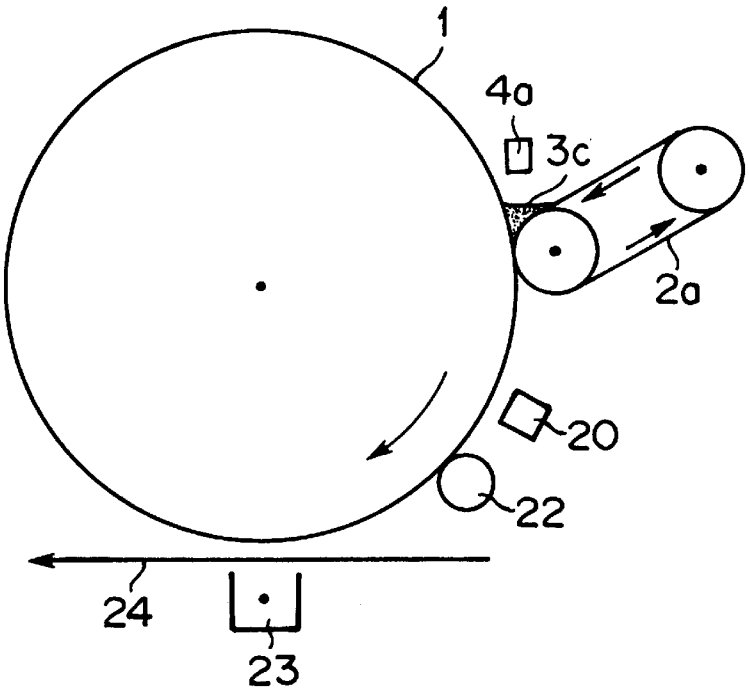
FIGS. 6A and 6B are diagrams of the combination of the photoconductor drum 1 and an endless-belt shaped charging member 2*a*.
Figure 6B:
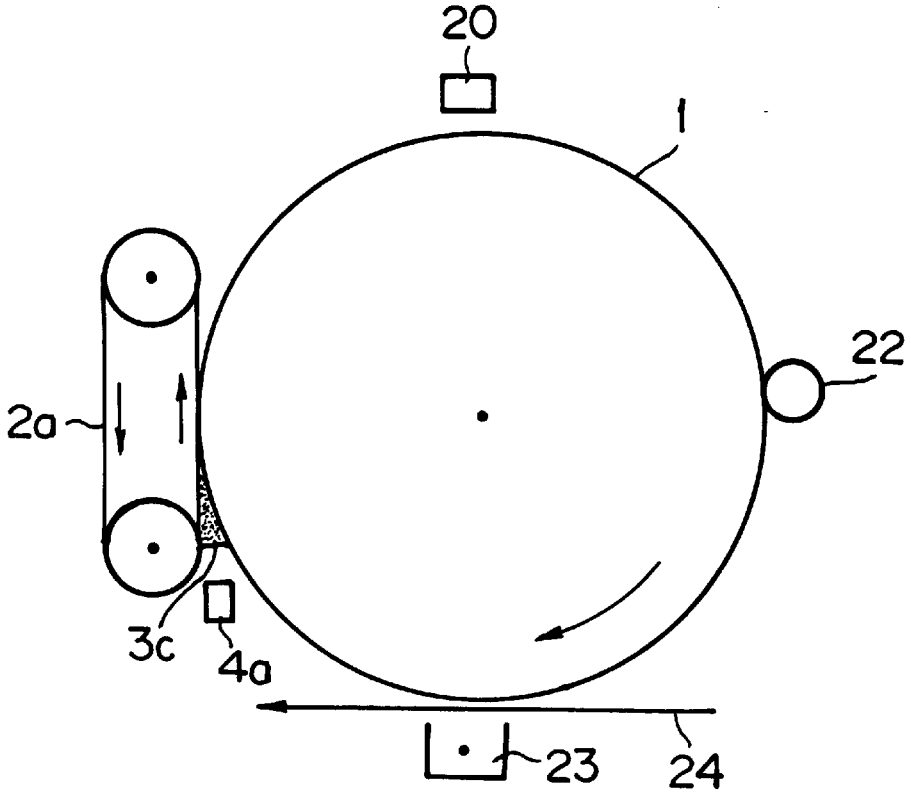

FIGS. 6A and 6B are diagrams of the combination of the photoconductor drum 1 and an endless-belt shaped charging member 2*a*.

Figure 6C:
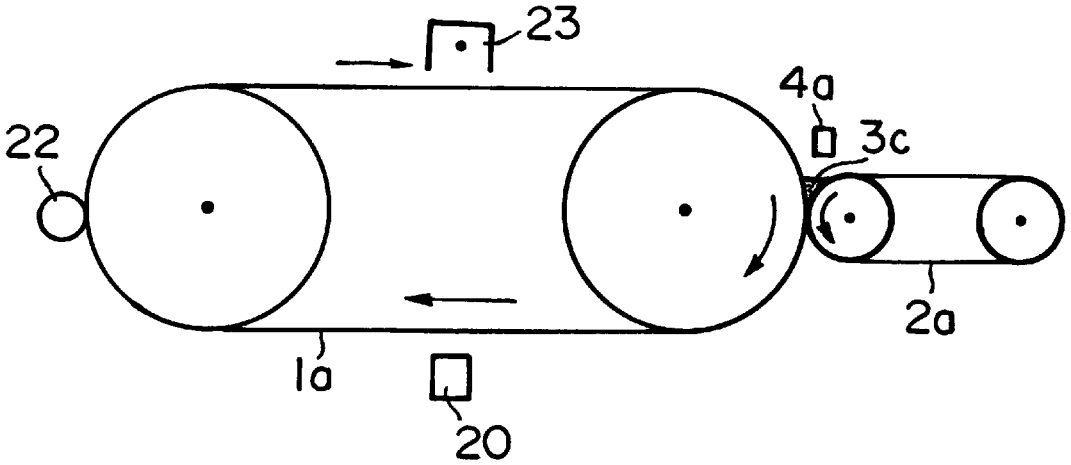
FIG. 6C is a diagram of the combination of the endless-belt shaped photoconductor la and the endless-belt shaped charging member 2*a*.

FIG. 6C is a diagram of the combination of the endless-belt shaped photoconductor 1*a* and the endless-belt shaped charging member 2*a*.

Figure 7A:
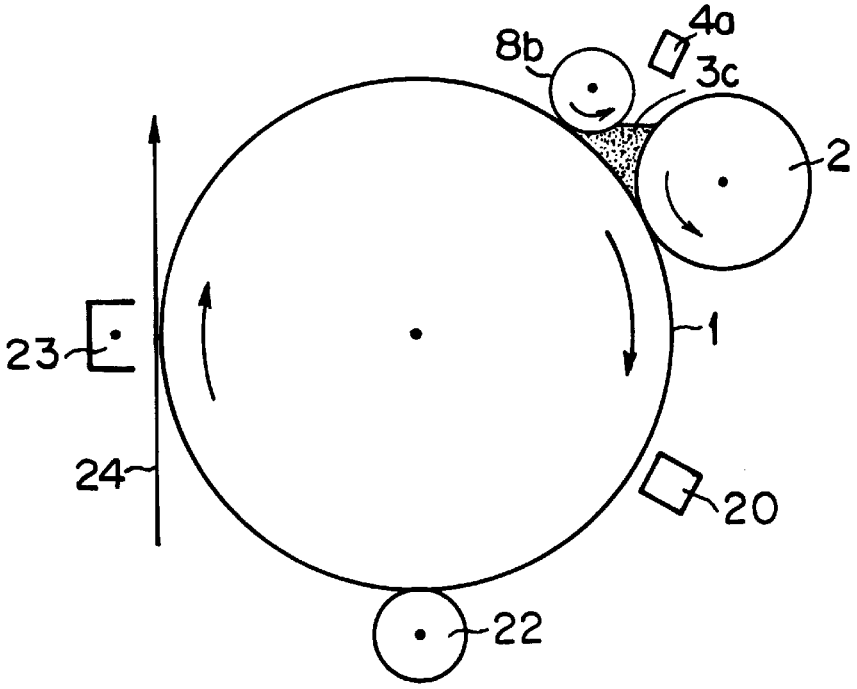
FIGS. 7A and 7B are diagrams of other combinations of the photoconductor drum 1 and the charging roller 2.
Figure 7B:
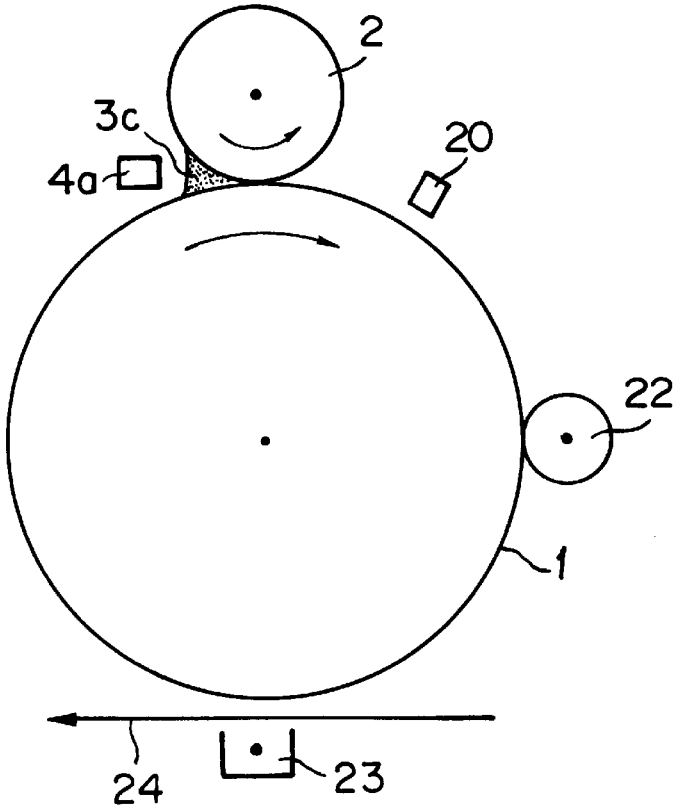

FIGS. 7A and 7B are diagrams of other combinations of the photoconductor drum 1 and the charging roller 2. In FIG. 7A, reference numeral 8*b* indicates a rotable member.

Figure 8:
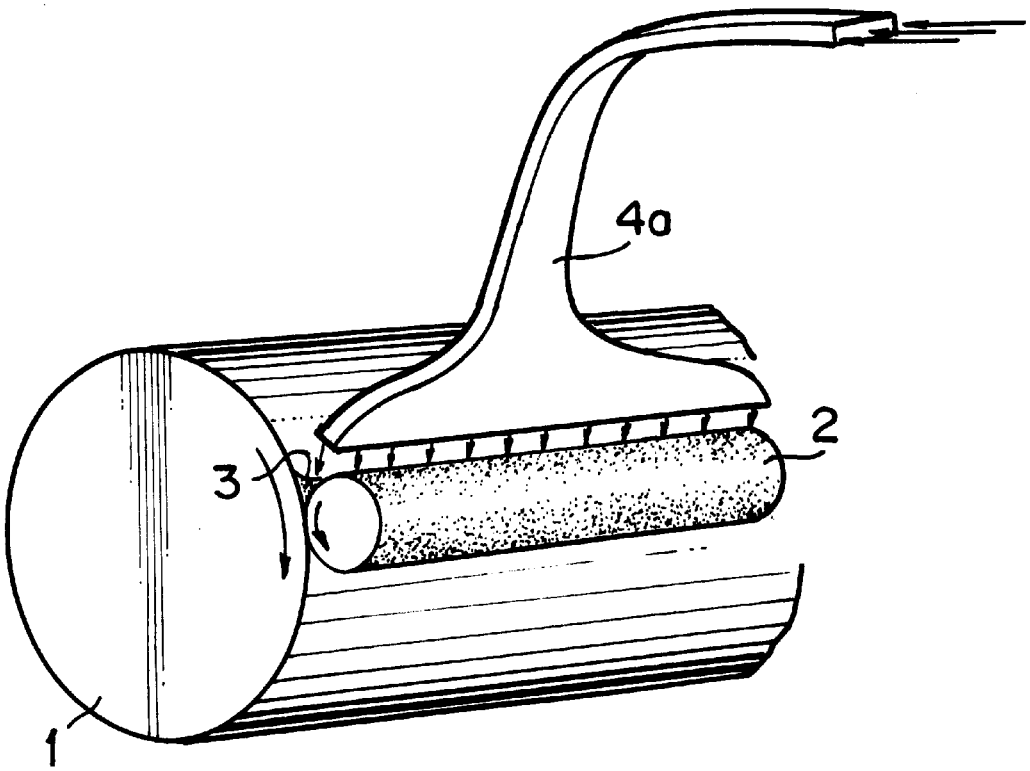
FIG. 8 is a schematic perspective view of a nozzle 4*b* for supplying the non-ozone-generating gas to the chargeable space 3 formed between the photoconductor drum 1 and the charging roller 2.

FIG. 8 is a schematic perspective view of a nozzle 4*b* for supplying the non-ozone-generating gas to the chargeable space 3 formed between the photoconductor drum 1 and the charging roller 2.

Japanese Patent Applications Nos. 09-123190 and 09-123192 filed Apr. 25, 1997, Japanese Patent Applications Nos. 09-125032 and 09-125033 filed Apr. 28, 1997, Japanese Patent Application filed Mar. 4, 1998, and two Japanese Patent Applications filed Apr. 22, 1998 are hereby incorporated by reference.

What is claimed is:

1. An image formation apparatus comprising;

image bearing means which is capable of bearing a latent electrostatic image formed thereon, contact charging means which charges a surface of said image bearing means with the application of electric charges thereto, with said image bearing means and said charging means being in rotation contact, and non-ozone-generating gas supply means for supplying a non-ozone-generating gas to a chargeable space which extends from a contact position of said contact charging means with said image bearing means and is positioned between (a) a surface of said contact charging means and (b) a surface of said image bearing means, with said surfaces facing each other, on an upstream side of said contact position with respect to a rotating direction of said contact charging means, said non-ozone-generating gas being capable of hindering the generation of ozone which is generated in the course of the application of electric charges to the surface of said image bearing means by said contact charging means.

2. The image formation apparatus as claimed in claim 1, further comprising auxiliary space enclosure means for enclosing said chargeable space, which is in contact with at least one of 1) a surface of said image bearing means on an upstream side of said contact position with respect to a rotating direction of said image bearing means; and 2) a surface of said contact charging means on an upstream side of said contact position with respect to said rotating direction of said contact charging means.

3. The image formation apparatus as claimed in claim 1, further comprising shielding means for shielding said chargeable space at opposite sides thereof, the shielding means being located either on opposite end sides of said surface of said image bearing means in a direction perpendicular to a rotation direction of said image bearing means; or on opposite end sides of said contact charging means in a direction perpendicular to a rotation direction of said contact charging means.

4. The image formation apparatus as claimed in claim 2, further comprising shielding means for shielding said chargeable space at opposite sides thereof, the shielding means being located on opposite end sides of said image bearing means in a direction perpendicular to a rotation direction of said image bearing means; or on opposite end sides of said contact charging means in a direction perpendicular to a rotation direction of said contact charging means.

5. The image formation apparatus as claimed in claim 1, wherein said non-ozone-generating gas has a specific gravity greater than that of air and said chargeable space is situated in such a posture that said non-ozone-generating gas is prevented from dispersing out of said chargeable space.

6. The image formation apparatus as claimed in claim 2, further comprising pressure reduction means for reducing the pressure in said chargeable space.

7. An image formation apparatus comprising:

an image bearing member which is capable of bearing a latent electrostatic image formed thereon, a contact charging member which charges a surface of said image bearing member with the application of electric charges thereto, with said charging member being relocated in a predetermined direction in rotation contact with said image bearing member at the same rotation speed, and a non-ozone-generating gas supply member comprising a nozzle through which a non-ozone-generating gas is directed and supplied to a chargeable space which extends from a contact position of said contact charging member with said image bearing member and is enclosed by (a) a surface of said contact charging member, (b) a surface of said image bearing member, with said surfaces facing each other, on an upstream side of said contact position with respect to a rotating direction of said contact charging member, and (c) either a horizontal plane tangent to the contact charging member which intersects the image bearing member; or a horizontal plane tangent to said image bearing member which intersects the contact charging member, said non-ozone-generating gas being capable of hindering the generation of ozone which is generated in the course of the application of electric charges to the surface of said image bearing member by said contact charging member.

8. The image formation apparatus as claimed in claim 7, further comprising a rotatable auxiliary space enclosure member for enclosing said chargeable space, which is in contact with at least one of: 1) a surface of said image bearing member on an upstream side of said contact position with respect to a rotating direction of said image bearing member; and 2) a surface of said contact charging member on an upstream side of said contact position with respect t o said rotating direction of said contact charging member.

9. The image formation apparatus as claimed in claim 7, wherein said image bearing member and said contact charging member are each in the shape of a cylindrical drum, and said image formation apparatus further comprises a pair of shielding members for shielding said chargeable space at opposite sides thereof, disposed in a direction perpendicular to the rotating direction of said image bearing member or said contact charging member, each of said pair of shielding members being disk-shaped. said shielding members being either: 1) attached to opposite ends of said image bearing member and having a diameter larger than a diameter of said image bearing member; or 2) attached to opposite ends of said contact charging member and having a diameter larger than a diameter of said contact charging member.

10. The image formation apparatus as claimed in claim 8, wherein said image bearing member and said contact charging member are each in the shape of a cylindrical drum, and said image formation apparatus further comprises a pair of shielding members for shielding said chargeable space at opposite sides thereof, disposed in a direction perpendicular to the rotating direction of said image bearing member or said contact charging member, each of said pair of shielding members being disk-shaped, said shielding members being either: 1) attached to opposite ends of said image bearing member and having a diameter larger than a diameter of said image bearing member, or; 2) attached to opposite ends of said contact charging member and having a diameter larger than a diameter of said contact charging member.

11. The image formation apparatus as claimed in claim 7, wherein said nozzle of said non-ozone-generating gas supply member causes said non-ozone-generating gas to flow along said surface of said contact charging member and surface of said image bearing member within said chargeable space.

12. The image formation apparatus as claimed in claim 7, further comprising a drive member for driving said contact charging member in rotation in a direction opposite to the rotating direction of said image bearing member.

13. The image formation apparatus as claimed in claim 7, further comprising a pressure reduction member for reducing the pressure in said chargeable space.

14. The image formation apparatus as claimed in claim 8, wherein said rotatable auxiliary space enclosure member is in contact with either: 1) a surface of said image bearing member with a gap between said rotatable auxiliary space enclosure member and said contact charging member; or 2) a surface of said contact charging member with a gap between said rotatable auxiliary space enclosure and said image bearing member.

15. The image formation apparatus as claimed in claim 7, wherein said non-ozone-generating gas has a specific gravity greater than that of air.

16. The image formation apparatus as claimed in claim 15, wherein said non-ozone-generating gas is carbon dioxide.

* * * * *